US005353657A

United States Patent [19]

Bainbridge, III

[11] Patent Number: 5,353,657

[45] Date of Patent: Oct. 11, 1994

[54] AIRPLANE ENGINE STARTER SYSTEM AND HOUSING

[76] Inventor: William C. Bainbridge, III, 123 E. 4th St., Newton, Kans. 67114

[21] Appl. No.: 19,677

[22] Filed: Feb. 19, 1993

[51] Int. Cl.[5] ..... F02N 15/06

[52] U.S. Cl. ..... 74/7 A; 74/7 E; 74/606 R; 123/179.27

[58] Field of Search ..... 74/6, 7 R, 7 C, 7 A, 74/7 E, 606 R; 123/179.27

[56] References Cited

U.S. PATENT DOCUMENTS

| | | | |
|---|---|---|---|
| D. 302,982 | 8/1992 | Bainbridge, III | D15/5 |
| 2,457,311 | 12/1948 | Kidd | 123/179.27 X |
| 3,771,372 | 11/1973 | Asahi et al. | 74/7 R |
| 4,155,266 | 5/1979 | Bradley | 123/179.27 X |
| 4,440,033 | 4/1984 | Kurihara et al. | 74/7 A |
| 5,129,270 | 7/1992 | Hasebe | 74/7 E X |

FOREIGN PATENT DOCUMENTS

| | | | |
|---|---|---|---|
| 55-117072 | 9/1980 | Japan | 74/6 |
| 59-54768 | 3/1984 | Japan | 74/7 R |

OTHER PUBLICATIONS

B & C Speciality Products Sales Brochure dated Jun. 1990.

Service Bulletin from Continental Motors Corp., dated Dec. 10, 1946.

*Primary Examiner*—Allan D. Herrmann

*Attorney, Agent, or Firm*—Litman, McMahon & Brown

[57] ABSTRACT

A starting system for an internal combustion engine includes a starter motor and solenoid mounted within separate, angularly spaced receptacles of a reduction gear housing. The starter motor drives a reduction gear within a the gear housing, which, in turn, drives a pinion gear on a shaft. The solenoid controls a retractable rod which selectively pivots a cantilever arm within the housing. The pivoted cantilever arm pushes the pinion gear shaft against the action of a coil spring, which urges the pinion gear into engagement with the engine flywheel ring gear, turning the flywheel ring gear. The solenoid also acts as a switch for the starter motor. When the engine is started, power is removed from the solenoid, which causes the rod to extend, pivoting the cantilever arm in the opposite direction, and allowing the spring to withdraw the pinion gear from engagement with the flywheel ring gear. A plurality of strengthening ribs give the housing strength with a minimal weight addition. The starter system is particularly useful as a retrofit replacement for an existing Continental aircraft engine starter.

9 Claims, 2 Drawing Sheets

AIRPLANE ENGINE STARTER SYSTEM AND HOUSING

BACKGROUND OF THE INVENTION

1. Field of the Invention

This invention is directed to a starter system for an internal combustion engine, and more particularly to a system including a starter motor and a solenoid driven pinion gear retraction system for use on existing aircraft engines.

2. Description of the Related Art

The development of internal combustion engines for airplanes has tracked somewhat with the development of automobile engines. Early examples of both had no separate electrical system, relying exclusively on magnetos for spark generation and hand cranks in the case of automobiles or hand "propping" for airplanes, for starting. Separate, battery operated starting systems for automobiles were developed in the early part of the century, including crankshaft driven distributors and coil and gap spark systems, but, for reasons of safety, reliability, and weight considerations, airplanes continued to use magnetos for spark generation and hand propping for starting.

With the development of more powerful airplane engines and more efficient airframe designs, plus the need for more sophisticated, electrically driven instruments, separate electrical systems for airplanes were developed in the late 1920's and the 1930's. However, for most smaller general aviation airplanes, the addition of starters and generators still represented a weight penalty which could not be tolerated. This was especially true since the early iron core starter motors and generators with large copper windings were extremely heavy.

After World War II was over, the flying public demanded electric starting systems for even the smallest airplanes and many engines, such as the venerable Continental 0-200, which were previously hand-propped, were retrofitted with electric starters. However, in the case of the Continental 0-200 and others, most such starters were either equipped with hand-operated cable pinion gear extenders, or with sprage clutches which were placed in line with the pinion gears and which merely disengage the pinion gears from the starter reduction gear, meaning that the pinion gear was constantly turning when the engine was running. The resulting constant wear and tear on the pinion gears was considerable, resulting in a shortened effective gear life and consequent frequent expense.

With the recent veritable explosion in home-built and "kit" planes, interest in venerable engines such as the Continental 0-200 and others is very high. However, the archaic starter designs in such engines, including their excessive weight and the undue wear and tear resulting from constant gear engagement, has created a need for an improved starting system for existing Continental airplane engines.

While improved starter systems have been developed for other airplane engines, including virtually all Lycoming direct drive piston engines, these prior starter systems have incorporated the starter motor and a solenoid pinion gear retractor with actuating lever in a single reduction gear housing chamber, with the solenoid placed outboard of and in line with the starter motor. Referring to FIG. 3, note the arrangement of a starter motor 6' and a solenoid pinion gear retractor 7' in a single receptacle 4' within a reduction gear housing 3'. This arrangement creates a number of problems. For instance, carbon dust from the brushes of the starter motor 6' tends to enter the solenoid 7' via the receptacle 4', shortening solenoid life and interfering with the lever action. Also, placement of the solenoid 7' outboard of and approximately aligned with the motor 6', a configuration designed to minimize the induction of carbon dust into the solenoid, necessitates a much longer cantilever lever arm from the solenoid 7' to a pinion gear (not shown) than would be otherwise required. Finally, the placement of the solenoid 7' and the starter motor 6' in line with each other necessitates a bulkier, and therefor heavier reduction gear housing.

Accordingly, it is clear that a need exists for an improved starter system for existing airplane engines, such as the Continental 0-200 and similar engines. Such a starter system should have a reduction gear housing with separate receptacles for a starter motor and a solenoid operated pinion gear extender, should be lighter than existing starters, and should space the starter motor and solenoid on the housing such that a lighter housing and a shorter pinion gear actuating lever are required.

SUMMARY OF THE INVENTION

In the practice of the present invention, a starter for an internal combustion engine includes a basically circular reduction gear housing with a pair of angularly spaced and physically separate receptacles for accommodating a starter motor and a solenoid pinion gear extender, respectively. The pinion gear is adapted to turn with the reduction gear and is equipped with a spring which automatically retracts it when solenoid electrical power is removed. The starter motor is a modern, high efficiency, high RPM motor connected to drive the reduction gear. The housing incorporates a number of spoke-like strengthening ribs for added strength. The resulting starter system represents a considerable weight savings over conventional starter systems while providing greater torque and a reliable pinion gear retraction system with no migration of carbon dust from the starter motor to the solenoid. The angular displacement of the starter motor relative to the solenoid permits the use of a shorter lever arm for extending the pinion gear.

OBJECTS AND ADVANTAGES OF THE INVENTION

The principle objects and advantages of the present invention include: to provide an improved starter system for an aircraft internal combustion engine; to provide such a starter system with a reliable pinion gear equipped with a cantilevered solenoid driven extender and a spring retractor; to provide such a starter system with a modern, high efficiency, high RPM, yet lightweight motor; to provide such a system with a reduction gear housing which incorporates two angularly spaced, physically separate receptacles for the starter motor and the solenoid pinion gear extender; to provide such a system in which the housing is provided with strengthening ribs for additional strength; to provide such a starter system which represents a substantial improvement in performance over existing starters, while weighing substantially less; and to provide such a starter system which is particularly well suited for its intended purpose.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

I. Introduction and Environment

Figure 1:
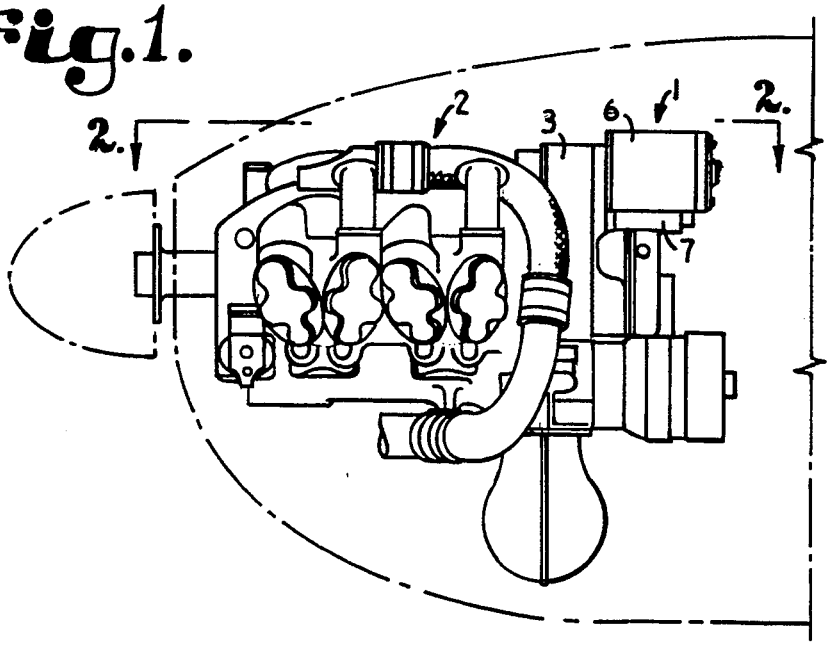
FIG. 1 a side elevational view of an aircraft engine equipped with a starter system in accordance with the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 2:
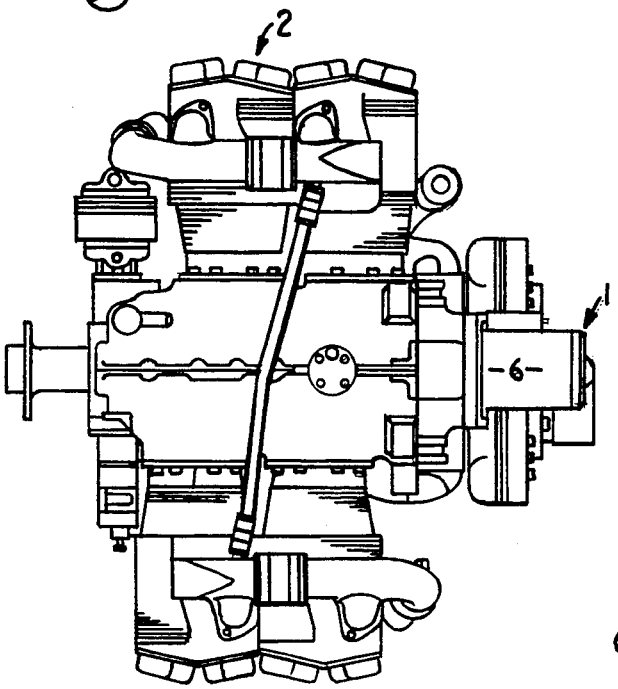
FIG. 2 is a top plan view of the aircraft engine equipped with the inventive starter system.
Figure 3:
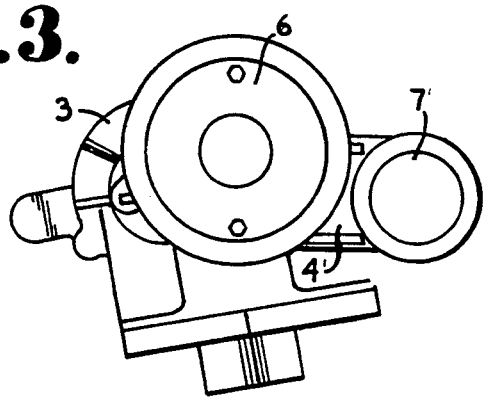
FIG. 3 is an enlarged, perspective view, of a prior art aircraft engine starter system.
Figure 4:
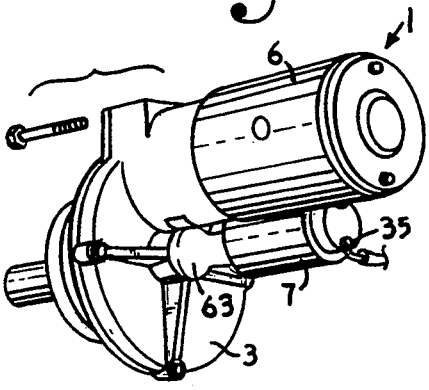
PRIOR ART Fig.4.
FIG. 4 is an enlarged, perspective view of the starter system in accordance with the present invention.
Figure 5:
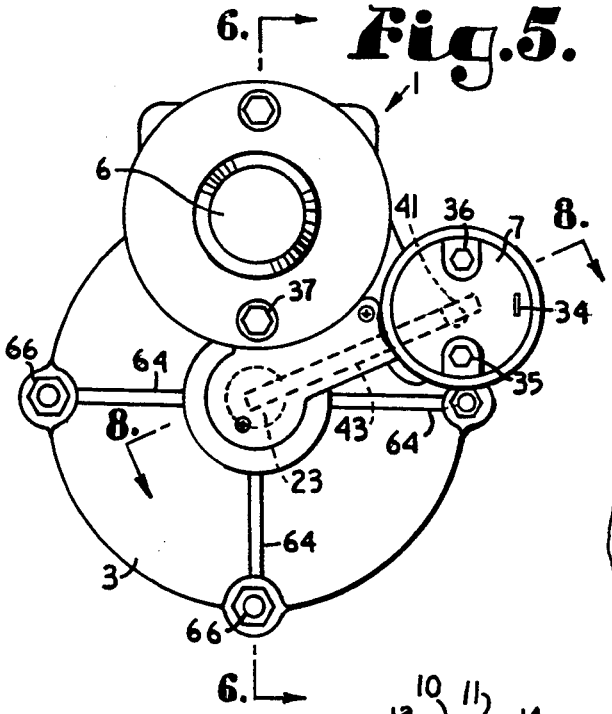
FIG. 5 is an enlarged, end elevational view of the starter system, illustrating a reduction gear housing with the starter motor and the solenoid mounted thereon, and with the solenoid-driven cantilever arm shown in phantom lines.

Referring to the drawings in more detail the reference numeral 1 in FIGS. 1 and 2 generally designates a starter system in accordance with the present invention, shown mounted on the top rear of an aircraft engine 2. As shown more clearly in FIGS. 4–6, the system 1 comprises a circular reduction gear housing 3, with a pair of angularly spaced and physically separate receptacles 4 and 5. A starter motor 6 and a solenoid 7 are mounted within the receptacles 4 and 5, respectively.

II. Starter Motor and Reduction and Pinion Gears

Figure 6:
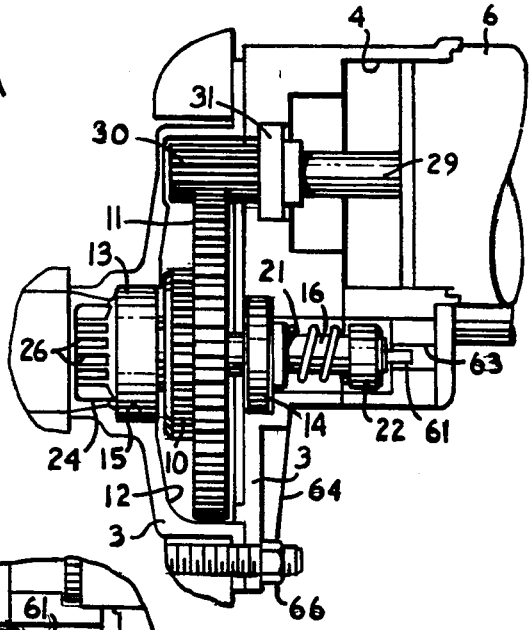
FIG. 6 is a further enlarged, fragmentary, cross-sectional view of the starter system, taken along line 6—6 of FIG. 5, illustrating the reduction gear system and a pinion gear and bearings with the pinion gear retracted.
Figure 7:
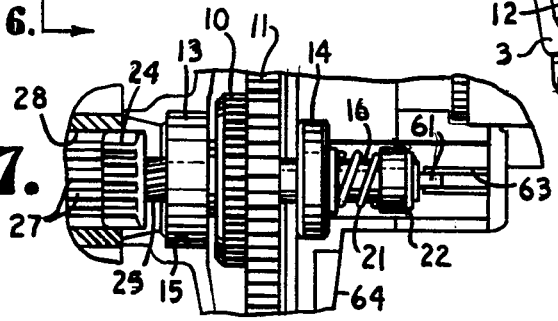
FIG. 7 is a further enlarged, fragmentary, and partially schematic cross-sectional view of the pinion gear of FIG. 6, illustrating the pinion gear engaged with the engine flywheel ring gear.

Referring more particularly to FIG. 6, the gear housing 3 houses a small gear wheel 10 which abuts a reduction gear 11 within a central chamber 12. A pair of ball bearings 13 and 14 are spaced on either side of the reduction gear 11. The bearing 13 can be press fit into a recess 15 in the housing 11. The bearings 13 and 14 support a pinion gear shaft 16 which is adapted to turn with the reduction gear 11. A coil spring 21 extends between the press fit bearing 13 and a spring keeper 22 which surrounds the pinion gear shaft 16 near one end 23 thereof. A pinion gear 24 is attached to the shaft 16 at the opposite end and a twisted spline 25 is formed on the shaft 16 behind the pinion gear 23. In a well-known fashion, the twisted spline 25 turns the pinion gear shaft 16 as the shaft 16 is engaged, insuring that the gear teeth 26 on the pinion gear 24 will mesh with corresponding ring gear teeth 27 on an engine flywheel 28 (FIG. 7). The coil spring 21 acts to push the keeper 22 rightwardly in FIG. 6, thus insuring that the pinion gear 24 will be retracted away from the flywheel 28 in the event that electrical power is lost or shut off from the solenoid 7 while the pinion gear 24 and the flywheel 28 are engaged. The starter motor 6 spins a shaft 29 to which is attached a gear 30, which drives the reduction gear 11. A pair of ball bearings, of which only bearing 31 is shown, surround and support the motor shaft 29 at either end.

III. Solenoid and Cantilever Lever Arm and Spring

Figure 9:
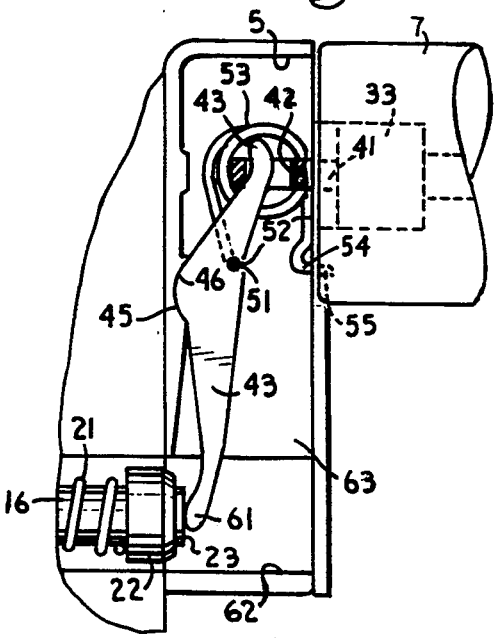
FIG. 9 is a further enlarged, fragmentary, cross-sectional view of the solenoid, cantilever arm and cantilever arm spring, taken along line 8—8 of FIG. 5, illustrating the solenoid arm in an extended position, which retracts the pinion gear.
Figure 8:
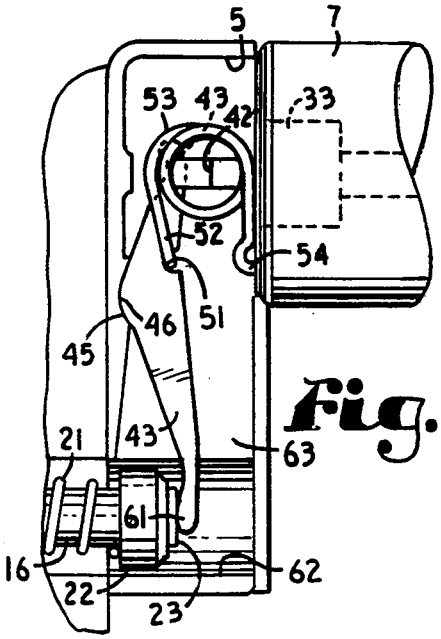
FIG. 8 is a further enlarged, fragmentary, cross-sectional view of the solenoid, cantilever arm and cantilever arm spring, taken along line 8—8 of FIG. 5, illustrating the solenoid arm in a retracted position, which extends the pinion gear.

Referring to FIGS. 8 and 9, the action of the solenoid 7 will now be described. The solenoid 7 is both a linear actuator for the pinion gear and a switch for the starter motor. The solenoid 7 comprises a movable plunger 33, shown in phantom lines. A blade terminal 34 is internally connected to terminal 35 via a coil (not shown) which energizes the plunger 33. The application of electrical power to terminal 35 thus energizes the blade terminal 34 which causes the plunger 33 to be retracted. This causes an armature-connected rod 41 to be retracted as well. The rod 41 has an elongate bore 42 near the exposed end thereof, through which one end 44 of a cantilever arm 43 is inserted. The cantilever arm 43 comprises a raised pivot surface 45 on one side thereof, which pivot surface 45 engages a pivot recess 46 in the housing 3. A spring engaging recess 51 on the opposite side of the cantilever arm 43 engages a center portion 52 of a spirally wound spring 53. Two ends of the spring 53, of which only one end 54 is shown in FIGS. 8 and 9, are received within a corresponding pair of bores 55, of which one is shown in phantom lines in FIG. 9. An opposite end 61 of the cantilever arm 43 extends into a recess 62 in the housing 3 and is positioned to engage the top end 23 of the pinion shaft 16. The cantilever arm 43 extends from the solenoid rod 41 to the pinion gear shaft end 23 through an elongate chamber 63 in the housing 3.

Once the plunger 33 is fully retracted, it also urges a washer (not shown) into shorting relationship between terminals 35 and 36. Terminal 36 is permanently connected to a positive lead 37 of the starter motor 6. Thus, the solenoid 7 also acts as a switch for the motor 6, only switching on the motor 6 after the pinion gear 24 is fully engaged with the flywheel 28.

To provide additional strength to the housing 3 with minimal additional weight, the housing 3 is constructed with a plurality of spoke-like ribs 64 extending from a center portion 65 of the housing 3 to a like plurality of attachment appendages 66.

IV. Operation

The operation of the starter system will now be described with reference to FIGS. 1, 2 and 4–9. When the engine 2 is to be started, a starter switch (not shown), which can be integrated into a magneto switch or can constitute a separate switch, is turned on, supplying power to the solenoid terminal 35. The solenoid 7 retracts the plunger 33 against the action of the spring 53, which causes the cantilever arm 43 to pivot about the recess 51 in the housing 3. The pivoting cantilever arm 43 thus urges the pinion gear shaft 16 to the left in FIGS. 7–9, pushing the turning pinion gear 24 into engagement with the flywheel 28. As the pinion gear shaft 16 is extended, the twisted spline 25 insures that the gear teeth 26 on the pinion gear 24 will mesh with the ring gear teeth 27 on the flywheel 28. The solenoid then internally shorts contacts 34 and 35 to provide power to the starter motor terminal 37. The starter motor 6 spins the shaft 29 and gear 30 and thus the reduction gear 11 which turns the pinion gear shaft 16. Once the engine 2 has started, the starter switch is released and the solenoid 7 extends the rod 41. This action, coupled with the spring action of the spring 53, causes the cantilever arm 43 to pivot in the opposite direction, and permits the spring 21 to retract the pinion gear shaft 16, thus retracting the pinion gear 24 from engagement with the flywheel ring gear 26. At the same time, power is removed from the starter terminal 37 by opening the connection between solenoid terminals 35 and 36.

The resulting starter system 1 is an improved, lighter weight, and more reliable starter than was previously available for the Continental 0-200 and similar engines. A number of innovative features are incorporated, including separate housing receptacles for the starter motor 6 and the solenoid 7 within a generally circular housing 3, the resulting shortened cantilever arm 43, and the use of strengthening ribs 64 for added strength with a minimal weight penalty.

It is to be understood that while certain forms of the present invention have been illustrated and described herein, it is not to be limited to the specific forms or arrangement of parts described and shown.

What is claimed and desired to be secured by Letters Patent is as follows:

1. In a starter system comprising a starter motor driving a gear, a reduction gear meshing with said gear, a pinion gear adapted to turn with said reduction gear and adapted to mesh with an engine flywheel ring gear, and an electromechanical actuator means for extending said pinion gear into engagement with said ring gear when power is supplied to said starter motor, the improvement comprising:

(a) a housing means containing a central chamber for said reduction gear and pinion gear and first and second receptacles which are physically separate;

(b) said starter motor being mounted on said housing within said first receptacle;

(c) said electromechanical actuator means being mounted on said housing within said second receptacle;

(d) an elongate enclosed space within said housing, said enclosed space extending between said second receptacle and said central chamber; and (e) a lever arm extending between said electromechanical actuator and a pinion gear shaft through said elongate enclosed space, said lever arm being responsive to said electromechanical actuator to selectively cause said pinion gear to mesh with said ring gear.

2. A starter system as in claim 1, wherein:

(a) said central chamber is approximately circular in shape; and (b) said first and said second receptacles are spaced about the periphery of said central chamber.

3. A starter system as in claim 1, wherein:

(a) said electromechanical actuator means comprises a solenoid connected to electrical power when said starter motor is so connected, said solenoid including a rod which id retracted when electrical power is supplied to said starter motor and said solenoid and is extended when electrical power is removed from said starter motor and said solenoid; and (b) said lever arm has one end extending through a bore in said solenoid rod and the other end engaging said pinion gear shaft whereby said pinion gear is extended when said solenoid rod is retracted; said other end of said lever arm being withdrawn from said pinion gear shaft when said solenoid rod is extended, said lever arm being mounted within said elongate enclosed space within said housing which elongate space extends between said second receptacle and said pinion gear shaft without extending through said first receptacle; said lever arm being pivotable about a recess within said elongate enclosed space, and a first spring means positioned within said elongate enclosed space and attached to said lever arm for normally urging said other end of said lever arm to withdraw from said pinion gear shaft.

4. A starter system as in claim 3, and further comprising:

(a) a second spring means adapted to retract said pinion gear away from said flywheel ring gear when said other end of said lever arm is withdrawn from said pinion gear shaft.

5. A starter system as in claim 4, wherein:

(a) said housing means comprises a plurality of strengthening ribs extending from the center to the edges thereof.

6. In a starter system comprising a starter motor driving a gear, a reduction gear meshing with said gear, a pinion gear adapted to turn with said reduction gear and adapted to mesh with an engine flywheel ring gear, and a solenoid actuator for extending said pinion gear into engagement with said ring gear when power is supplied to said starter motor, the improvement comprising:

(a) a housing means containing a generally circular central chamber for said reduction gear and pinion gear and first and second receptacles which are angularly spaced about said circular chamber and which are physically separate;

(b) said starter motor being mounted on said housing within said first receptacle;

(c) said solenoid actuator means being mounted on said housing within said second receptacle;

(d) said solenoid actuator including a rod which is retracted when electrical power is supplied to said starter motor and is extended when electrical power is removed from said starter motor;

(e) a lever arm with one end extending through a bore in said solenoid rod and the other end engaging a pinion gear shaft whereby said pinion gear is extended when said solenoid rod is retracted; said other end of said lever arm being withdrawn from said pinion gear shaft when said solenoid rod is extended; said lever arm being mounted within an elongate enclosed space within said housing which elongate space extends between said second receptacle and said pinion gear shaft without extending through said first receptacle; said lever arm being pivotable about a recess within said elongate enclosed space, and a first spring means positioned within said elongate enclosed space and attached to said lever arm for normally urging said other end of said lever arm to withdraw from said pinion gear shaft; and (f) a second spring means adapted to retract said pinion gear away from said flywheel ring gear when said other end of said lever arm is withdrawn from said pinion gear shaft.

7. A starter system as in claim 6, wherein:

(a) said housing means comprises a plurality of strengthening ribs extending in a spoke-like fashion from the center to the edges thereof.

8. A starter system as in claim 6, wherein:

(a) said system is a starter for a Continental aircraft engine.

9. In a starter system for an aircraft engine comprising a starter motor driving a gear, a reduction gear meshing with said gear, a pinion gear adapted to turn with said reduction gear and adapted to mesh with an engine flywheel ring gear, and a solenoid actuator for extending said pinion gear into engagement with said ring gear when power is supplied to said starter motor, the improvement comprising:

(a) a housing means containing a generally circular central chamber for said reduction gear and pinion gear and first and second receptacles which are angularly spaced about said circular chamber and which are physically separate;

(b) said starter motor being mounted on said housing within said first receptacle;

(c) said solenoid actuator means being mounted on said housing within said second receptacle;

(d) said solenoid actuator including a rod which is retracted when electrical power is supplied to said starter motor and is extended when electrical power is removed from said starter motor;

(e) a lever arm with one end extending through a bore in said solenoid rod and the other end engaging a pinion gear shaft whereby said pinion gear is extended when said solenoid rod is retracted; said other end of said lever arm being withdrawn from said pinion gear shaft when said solenoid rod is extended; said lever arm being mounted within an elongate enclosed space within said housing which elongate space extends between said second receptacle and said pinion gear shaft without extending through said first receptacle; said lever arm being pivotable about a recess within said elongate enclosed space, and a first spring means positioned within said elongate enclosed space and attached to said lever arm for normally urging said other end of said lever arm to withdraw from said pinion gear shaft;

(f) a second spring means adapted to retract said pinion gear away from said flywheel ring gear when said other end of said lever arm is withdrawn from said pinion gear shaft; and (g) a plurality of strengthening ribs extending in a spoke-like fashion from the center of said housing to the edges thereof.

* * * * *